US006173786B1

(12) United States Patent
Sampson et al.

(10) Patent No.: US 6,173,786 B1
(45) Date of Patent: Jan. 16, 2001

(54) PRESSURE-ACTUATED RUNNING TOOL

(75) Inventors: Timothy W. Sampson, Spring; Van N. Ho, Houston; Garry R. Kaiser, Spring, all of TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/265,297

(22) Filed: Mar. 9, 1999

(51) Int. Cl.[7] ..... E21B 23/08
(52) U.S. Cl. ..... 166/383; 166/123; 166/181
(58) Field of Search ..... 166/381, 383, 166/385, 117, 123, 181, 182

(56) References Cited

U.S. PATENT DOCUMENTS

| | | | | |
|---|---|---|---|---|
| 3,378,080 | * | 4/1968 | Fredd | 166/156 |
| 4,361,188 | | 11/1982 | Russell | 166/381 |
| 5,044,442 | * | 9/1991 | Nobileau | 166/382 |
| 5,086,844 | * | 2/1992 | Mims et al. | 166/383 |
| 5,146,983 | * | 9/1992 | Hromas et al. | 166/66.7 |
| 5,180,015 | | 1/1993 | Ringgenberg et al. | 166/386 |
| 5,242,201 | | 9/1993 | Beeman | 294/86.17 |
| 5,580,114 | | 12/1996 | Palmer | 294/86.15 |
| 5,775,433 | * | 7/1998 | Hammett et al. | 166/98 |
| 5,794,694 | * | 8/1998 | Smith, Jr. | 166/212 |
| 5,988,277 | * | 11/1999 | Vick, Jr. et al. | 166/123 |
| 6,050,341 | * | 4/2000 | Metcalf | 166/383 |

FOREIGN PATENT DOCUMENTS 2310872 9/1997 (GB) .

OTHER PUBLICATIONS

Baker Oil Tools, Technical Unit, Hang and Release System Less Wireline Landing Assembly with Models "GRD" and "HR" Running Tools, 4 pages, Feb. 1999.

Baker Production Services, Training Manual, Baker Model "M" Running and Pulling Tool and Baker Soft Release Running Tool, 2 pages, Mar. 1995.

Halliburton; Web Page for Modular Gun System, 6 pages, 1997.

* cited by examiner

*Primary Examiner*—David Bagnell
*Assistant Examiner*—Jennifer Dougherty
(74) *Attorney, Agent, or Firm*—Duane, Morris & Heckscher LLP

(57) ABSTRACT

A running tool is disclosed to deliver tools downhole, preferably supported on a wireline. The running tool will not release the downhole tool before the desired depth is reached, even if an obstruction is encountered. The tool has the ability to release upon application of pressure in the wellbore. The tool features a floating piston with a pre-charged chamber on one side. Hydrostatic pressure acts on the opposite side of the floating piston as the running tool descends. When the downhole tool reaches its desired depth and becomes supported, slacking on the wireline traps the hydrostatic on one side of the floating piston. Applied wellbore pressure, acting on a release piston exposed to the trapped hydrostatic on its opposite side, shifts the release piston and releases the running tool from the downhole tool. On the way uphole, the trapped hydrostatic pressure is released.

21 Claims, 6 Drawing Sheets

PRESSURE-ACTUATED RUNNING TOOL

FIELD OF THE INVENTION

The field of this invention relates to running tools and, more particularly, wireline-supported tools which are automatically resettable and which will not prematurely release the downhole tool being run until a predetermined hydraulic force is applied after the tool is landed on location.

BACKGROUND OF THE INVENTION

In some facilities, the appropriate rig is not available and tools cannot be run-in on rigid or coiled tubing. In those instances, the downhole tools are connected to a running tool which is, in turn, supported by one type or another of a line. One common form is a wireline; however, other types of line supports are intended to be encompassed in the term "line" or "wireline" as used in this application. One of the problems in the past with running in tools on wireline has been that if an obstruction of sorts is encountered prior to reaching the desired depth, the running tools of the prior art would release. In some designs, if the downhole tool becomes supported, allowing the wireline to go slack and the wireline is subsequently tensioned, the running tool releases from the downhole tool. One variation in a wireline-supported running tool, that has been developed by Halliburton in its Modular Gun System, involves up and down movement on the wireline to set a gun hanger, followed by a decrease in wireline weight at the surface to verify that such a hanger had been set. When thereafter additional weight was slacked off, oil metered through an orifice flowed in the hydraulic running tool. After delay of some 5 minutes, the tool automatically released from the gun hanger. While this design allowed surface personnel to react to avoid an inadvertent release due to the time delay provided by metering the oil flow through a restriction orifice, a better design was needed to ensure that the tool being conveyed will not release from the running tool until it is properly positioned at the appropriate depth. Another requirement was to allow the running tool to automatically reset so that it could be reused for multiple-trip operations without having to be disassembled and redressed. This type of an issue is common in designs that break shear pins to allow a release mechanism to operate.

Some systems have been tried which incorporated a rupture disk which, in order to release, involved an increase in wellbore pressure to break the rupture disk. This, in turn, created an unbalanced force which broke a shear pin on a release piston, which in turn pulled locking collets off of their support. These designs were good for a single use and had to be disassembled to be redressed to replace the shear pins. An example of this design is the model GRD Running Tool, product No. 493-46 made by Baker Oil Tools.

Various tubing-conveyed fishing tools have been used which apply a force generated by fluid flow through an orifice for release. These tools would automatically reset after the hydraulic pressure was removed from the tubing. Typical examples of such tools are U.S. Pat. Nos. 5,242,201 and 5,581,014. However, these tools were not configured to operate on wireline. Yet other tools using wireline worked on the jarring concept. A Model W Running Tool from Baker Oil Tools required upward jarring to release the downhole tool. The Model M Running and Pulling Tool made by Baker Oil Tools required jarring down to shear a shear pin to remove support for dogs which held the downhole tool so that a release could occur. The soft release running tool, product No. 811-40 by Baker Oil Tools, released by an upward pull followed by a slacking off. Also of general interest in this area are U.S. Pat. Nos. 4,361,188 and 5,180,015.

The shortcoming of the prior art tools was that for a wireline application, they would not give assurance of premature release should the downhole tool become supported in a location above the desired depth. Additionally, these tools did not facilitate many trips in succession because they had to be redressed after each release due to their use of a shear pin or pins in the release mechanisms. Yet other designs in the prior art which provided the automatic resetting feature and released with hydraulic pressure required the running tool or fishing tool to be run-in the wellbore on rigid or coiled tubing. Accordingly, one of the objectives of the present invention is, in applications where equipment is not available to run rigid or coiled tubing, to have a running tool supported on a wireline which can give assurance that it will not prematurely drop the downhole tool, while at the same time providing features of automatic resetting, coupled with simple and safe operation. These objectives will be more readily understood by those skilled in the art from a review of the preferred embodiment described below.

SUMMARY OF THE INVENTION

A running tool is disclosed to deliver tools downhole, preferably supported on a wireline. The running tool will not release the downhole tool before the desired depth is reached, even if an obstruction is encountered. The tool has the ability to release upon application of pressure in the wellbore with the tool supported in the wellbore. The tool features a floating piston with a pre-charged chamber on one side. Hydrostatic pressure acts on the opposite side of the floating piston as the running tool descends. When the downhole tool reaches its desired depth and becomes supported, slacking on the wireline traps the hydrostatic on one side of the floating piston. Applied wellbore pressure, acting on a release piston exposed to the trapped hydrostatic on its opposite side, shifts the release piston and releases the running tool from the downhole tool. On the way uphole, the trapped hydrostatic pressure is released.

DETAILED DESCRIPTION OF THE PREFERRED EMBODIMENT

Figure 1A:
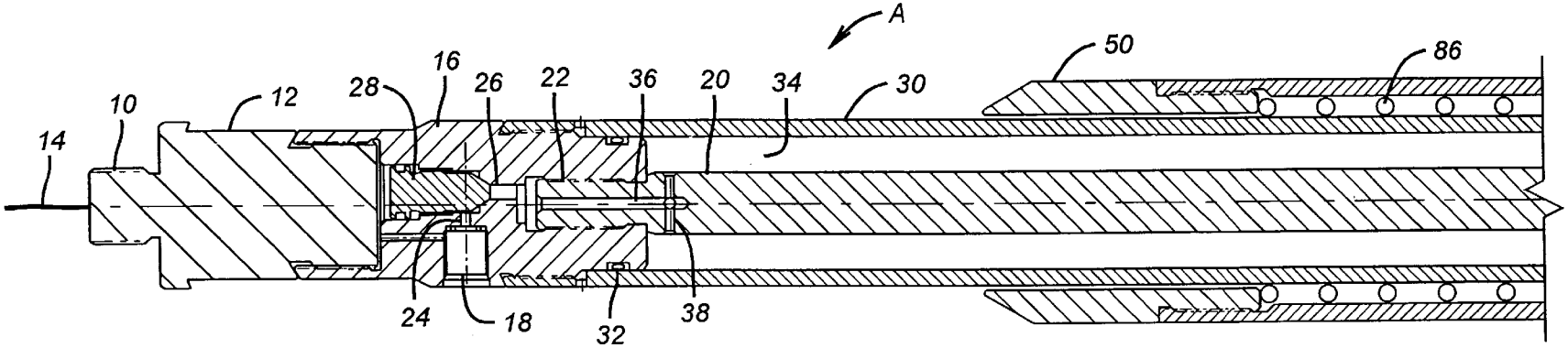
FIGS. 1*a* and *b* show in sectional elevation the downhole tool being inserted into the running tool prior to lowering into the well.

Referring to FIGS. 1*a* and *b,* the apparatus A has a connection 10 on adapter 12 which can be used as an attachment point for a line or wireline, shown schematically as 14. Connected to adapter 12 is top sub 16, which has a fill port 18. Top sub 16 is connected to mandrel 20 at thread 22'. Fill port 18 communicates with passage 24. Passage 24 is isolated from passage 26 by plug 28.

Outer sleeve 30 is in sealing engagement with top sub 16 due to seal 32. Sleeve 30 defines an annular cavity 34 around the mandrel 20. Passages 36 and 38 provide fluid communication from passage 26 into annular cavity 34. Passages 36 and 38 are in the mandrel 20. Mandrel 20 is connected to top sub 16 at thread 22. At the lower end of annular cavity 34 is floating piston 42. Piston 42 has seals 44 and 46, thus sealingly isolating the annular cavity 34 at its lower end.

Surrounding the outer sleeve 30 is a multi-component outer body 48 which begins with sleeve 50 at its top end and terminates at centralizer 52 at its lower end. Supported between the mandrel 20 and the outer body 48 is a gripping ring 54, which is biased by spring 56 in a downward direction toward shoulder 58 on outer body 48. The gripping ring 54 has an outer surface 60 of a series of fingers which have an inwardly oriented shoulder 62. Also between the gripping ring 54 and the mandrel 20 is a release piston 64. Release piston 64 extends between outer sleeve 30 and mandrel 20 and is sealed respectively by seals 66 and 68. A passage 70 in sleeve 30 leads to annular passage 72. Annular passage 72 communicates with passages 74 and 76 to poppet 78 which is biased by spring 80. Poppet 78 seals against a shoulder 82 which surrounds passage 76 such that when the pressure in passage 76 is higher than the hydrostatic pressure in the wellbore, the spring 80 is compressed, venting any pressure in passage 76 through passage 84.

Figure 2A:
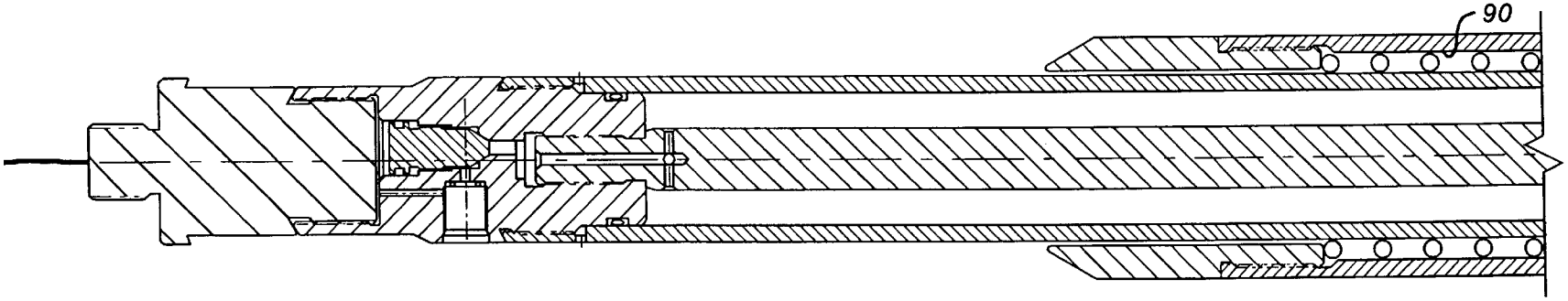
FIGS. 2*a* and *b* are a sectional elevational view of the running tool supporting the downhole tool on the trip downhole.

The outer body 48 is supported off of outer sleeve 30 by virtue of spring 86. In the run-in position shown in FIG. 1*b*, outer body 48 obstructs passage 70. However, when the downhole tool 88 is suspended on outer body 48, the spring 86 is compressed, bringing recessed surface 90 opposite passage 70, as shown in FIG. 2*b*, so as to expose annular passage 72 to hydrostatic wellbore pressure. The critical components of the preferred embodiment now having been described, its operation will be reviewed in greater detail.

Figure 1B:
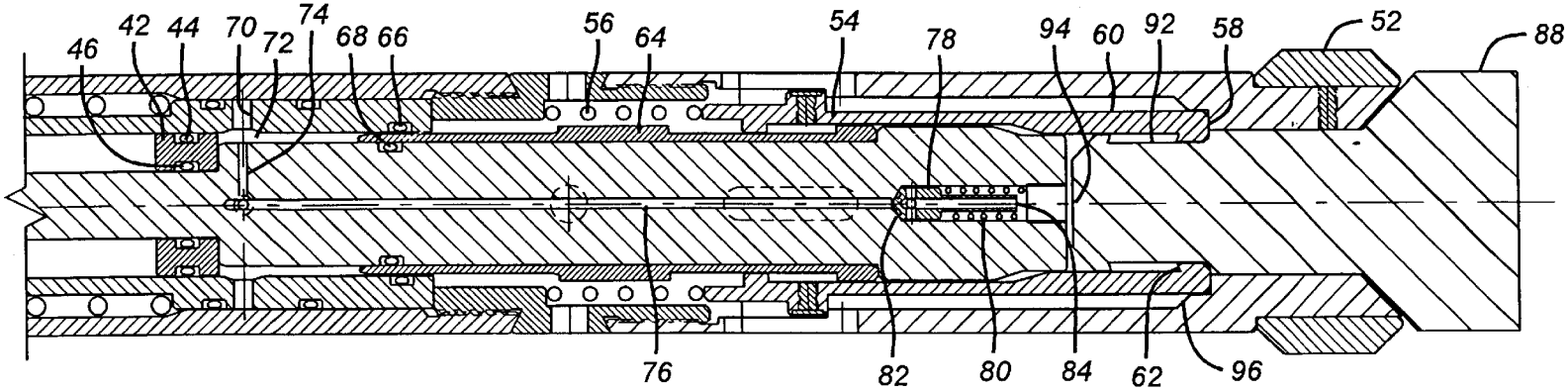
Figure 2B:
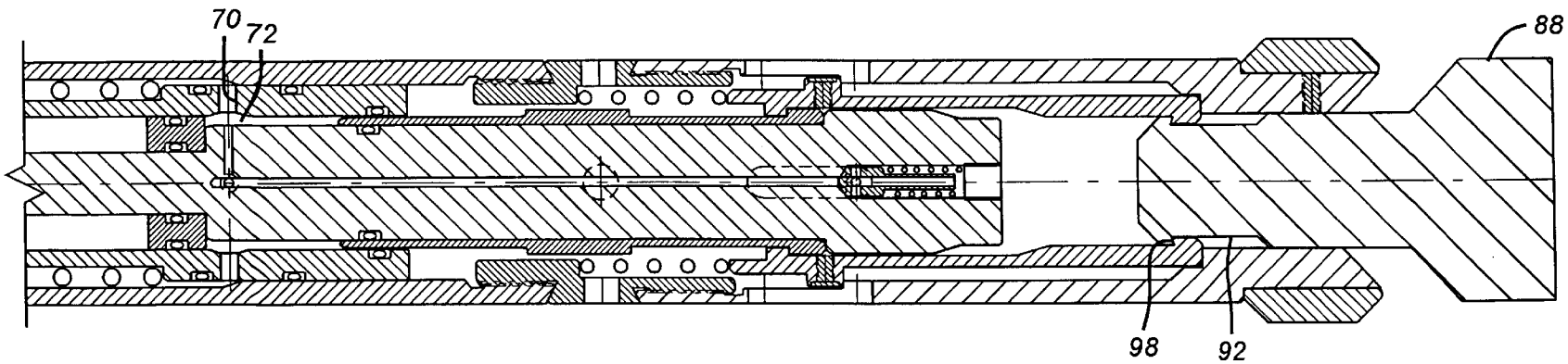

Referring to FIG. 1*b*, the downhole tool 88 has a recess 92 and an upper end 94. When upper end 94 is pushed against gripping ring 54, it displaces the gripping ring upwardly, away from shoulder 58 and outwardly on tapered surface 96. This allows the upper end 94 to advance beyond shoulder 62, whereupon the spring 56 pushes the gripping ring 54 back down against tapered surface 96 such that shoulder 62 now finds itself within recess 92, as shown in FIG. 1*b*. When the assembly is picked up for lowering into the wellbore, the view of FIG. 2 is achieved where the only difference between FIGS. 1 and 2 is that in FIG. 2, the shoulder 62 has caught the shoulder 98 at the upper end of recess 92. This is the position of the apparatus A with the downhole tool 88 as the assembly is lowered in the wellbore. As the apparatus A is being lowered in the wellbore, the suspension of the weight of the downhole tool 88 results in compression of spring 86 and presentation of recessed surface 90 opposite passage 70. Thus, as the apparatus A descends, the pressure in annular passage 72 reflects the surrounding hydrostatic pressure in the wellbore. The annular cavity 34 has been precharged with preferably nitrogen gas or some other compressible fluid to a pressure slightly below the anticipated hydrostatic in the wellbore at the desired depth for the downhole tool 88. This pressurization of the annular cavity 34 occurs by hooking up a source of nitrogen to filler port 18 while backing off the plug 28, thus providing fluid communication from passage 24 through passages 26, 36 and 38 into annular cavity 34. When the desired pressure is reached, the plug 28 is again rotated to seal off passage 26 from passage 24, thus trapping in the precharged pressure in annular cavity 34. As the apparatus A descends with hydrostatic pressure building in annular passage 72, the floating piston 42 stays in its lowermost position until such time as the hydrostatic pressure in annular passage 72 is greater than the precharged pressure in annular cavity 34.

Figure 3A:
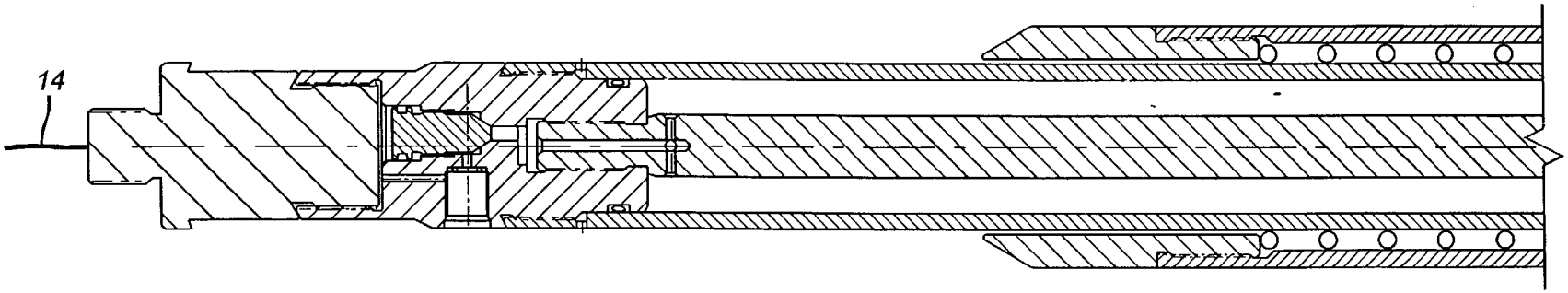
FIGS. 3*a* and *b* are the view of FIGS. 2*a* and *b,* shown after the downhole tool is firmly supported and the wireline is slacked off.

Looking at FIG. 3, the downhole tool 88 has either reached its desired depth and become supported or has hit an obstruction along the way. Because the downhole tool 88 is supported and the wire 14 is allowed to go slack, the result is that the gripping ring 54 travels to the lower end of the recess 92 but is still firmly engaged into recess 92 due to the support that it receives from the outer body 48. Accordingly, even if an obstruction is encountered, there will be no release as the gripping ring 54 will continue to retain the downhole tool 88 due to the fact that it is firmly supported in the recess 92 by outer body 48. However, when the ultimate depth required is, in fact, reached, the same movement shown in FIG. 3 will occur as the gripping ring 54 moves downwardly in recess 92, all the while retaining the connection to the downhole tool 88. A release can occur only when the downhole tool 88 is supported downhole and pressure is applied to port 100.

Figure 4A:
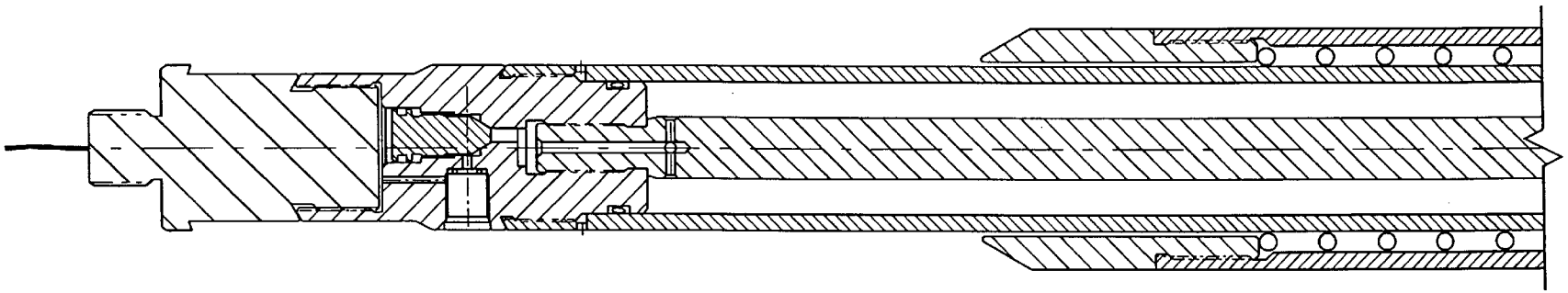
FIGS. 4*a* and *b* show the tool of FIGS. 3*a* and *b,* with the release piston shifted due to application of pressure in the wellbore.
Figure 3B:
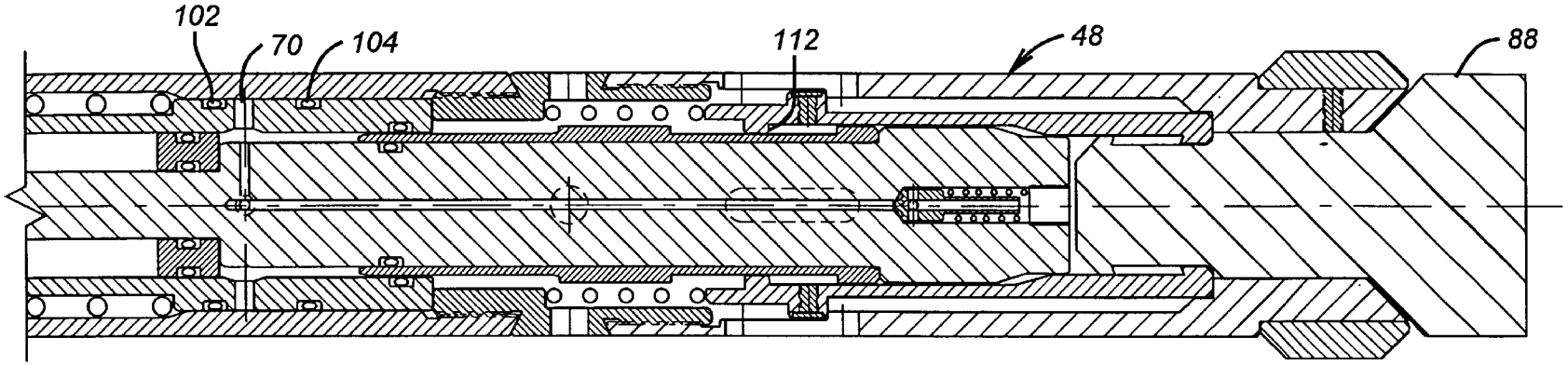
Figure 4B:
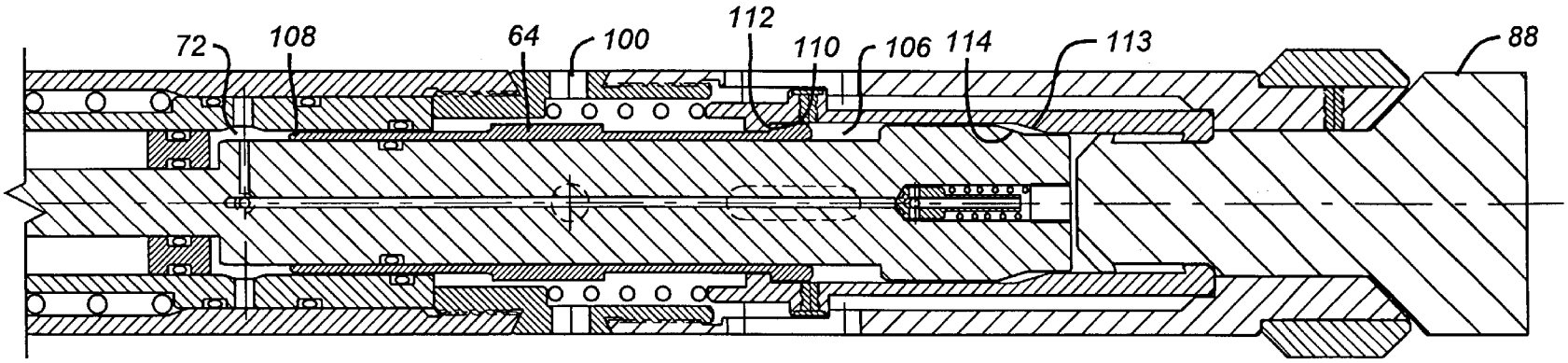
Figure 5A:
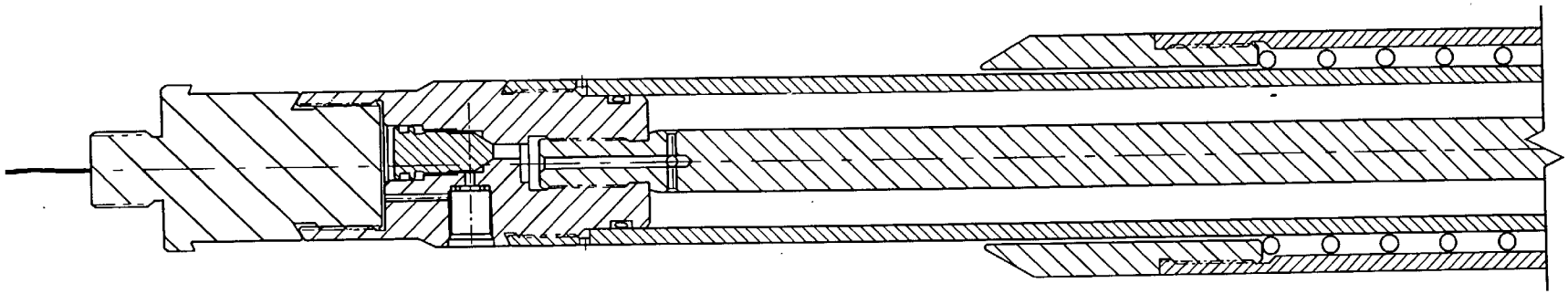
FIGS. 5*a* and *b* show the release piston further shifted and the downhole tool fully released.
Figure 5B:
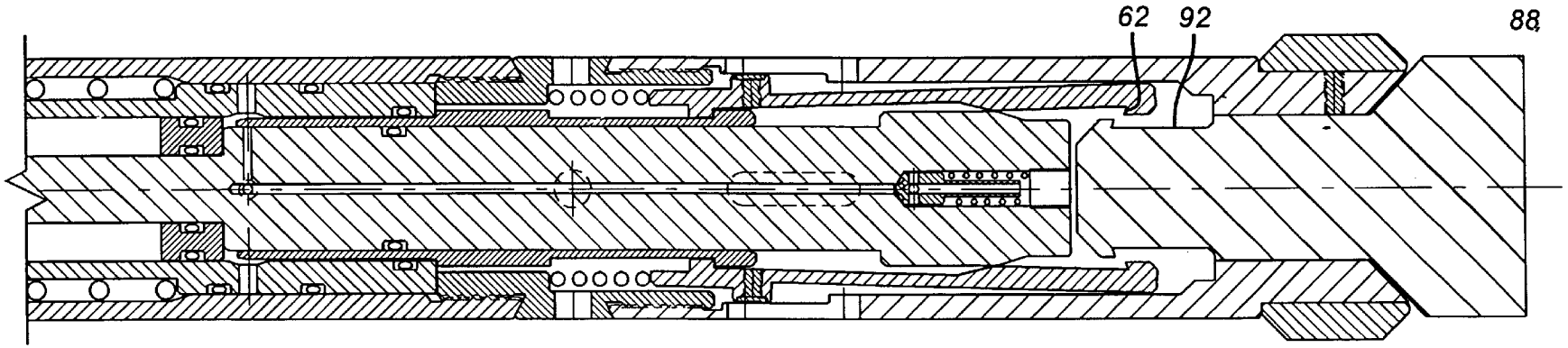

At this time, pressure is applied through port 100, as shown in FIG. 4. It should be noted that when the downhole tool is supported and the wire 14 is slacked off, the port 70 becomes sealingly obstructed due to seals 102 and 104, as shown in FIG. 3*b*. As shown in FIG. 4*b*, application of pressure at port 100 results in an upward force on end 106 of release piston 64. End 108 of piston 64 is exposed to the trapped pressure in annular passage 72. Eventually the pressure on end 106, through a build-up of pressure in the wellbore communicated through port 100, results in an unbalanced force on release piston 64. Release piston 64 has a shoulder 110 which engages a shoulder 112 on gripping ring 54. When these two shoulders connect, further upward movement of the release piston 64 brings up with it the gripping ring 54 and pulls the gripping ring 54 away from shoulder 58, as can be seen by comparing FIGS. 4*b* and 5*b*. The gripping ring 54 has tapered surfaces 113 which ultimately engage a taper 114 on the mandrel 20. Thus, upward movement of the release piston 64 cams the fingers which comprise the lower end of the gripping ring 54 radially outwardly, as shown in FIG. 5*b*, to bring shoulder 62 out of recess 92 to effect a complete release of the downhole tool 88 when an upward force is applied at the same time as the application of wellbore pressure.

Those skilled in the art can see that the precharging of annular cavity 34, which acts on piston 42, allows a reference hydrostatic pressure to be trapped in annular passage 72 against the compressible fluid trapped in passage 34 when the downhole tool 88 is supported downhole. This occurs because passage 70 is sealingly closed, as illustrated by comparing FIGS. 2*b* and 3*b*, as the recess surface 90 moves away from passage 70 and seals 102 and 104 effectively straddle passage 70, which is now fully covered by the outer body 48. With that reference pressure trapped, which is generally a pressure close to the wellbore hydrostatic at the desired location for release from the downhole tool 88, applied pressure on the wellbore on the release piston 64, one end of which 108 is exposed to the trapped hydrostatic pressure in the annular passage 72, results in the release sequence just described. It also moves the floating piston 42 and compresses the fluid in chamber 34.

Figure 6A:
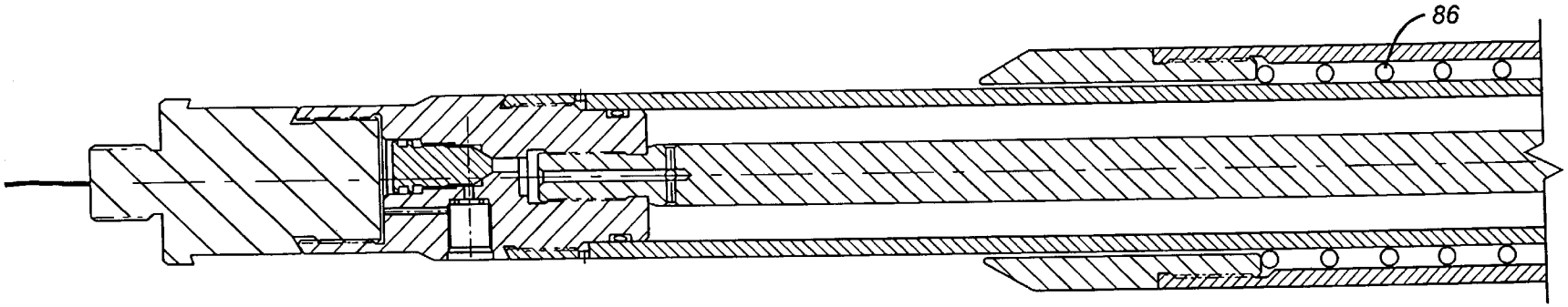
FIGS. 6*a* and *b* show the running tool being pulled out of the wellbore, with the trapped hydrostatic pressure vented off as the running tool rises out of the wellbore.
Figure 6B:
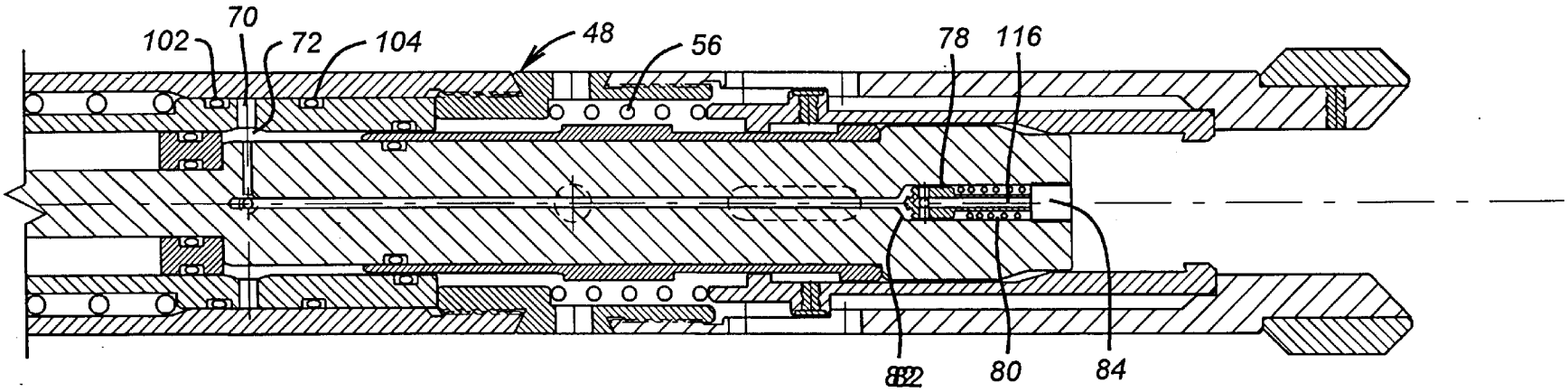

FIGS. 6*a* and *b* illustrate that on the way up the hole, annular passage 72 is still isolated from wellbore hydrostatic as passage 70 continues to be sealed off due to the upward force applied by spring 86, which keeps the outer body 48 over the passage 70, with seals 102 and 104 acting to prevent pressure loss out of annular passage 72. However, the hydrostatic pressure is decreasing as the apparatus A is elevated, and such reduced pressure is sensed at passage 84. Thus, as the apparatus A is raised, lowering the pressure in passage 84, the poppet 78 eventually sees a sufficient unbalanced force to overcome the spring 80, thus moving the poppet 78 off of the sealing surface or shoulder 82 so that the pressure in annular passage 72 can dissipate by flow through passage 116 and poppet 78, which becomes exposed when it is moved to the position shown in FIG. 6*b*. As the pressure in annular passage 72 decreases, the pressure in annular cavity 34 correspondingly decreases such that by the time the apparatus A is withdrawn from the wellbore, the originally charged pressure into annular cavity 34 is once again present.

The pressure in annular cavity 34 can be manually bled off by hooking up the requisite valving and piping to the fill port 18 and backing off plug 28.

Those skilled in the art will now appreciate that what has been shown is a running tool which can be run on a wireline 14 or, for that matter, on rigid or coiled tubing as an alternative. There will be no release of the downhole tool 88, even if the downhole tool 88 becomes supported in the wellbore at a depth higher than its ultimate destination. The apparatus A is released by application of pressure in the wellbore to a release piston, the other side of which sees a trapped hydrostatic pressure. The floating piston 42, acting on a compressible fluid, such as nitrogen, in annular cavity 34, provides the capability of compressing the compressible fluid to enable movement of the release piston 64. An upward pull on line 14 with applied wellbore pressure through port 100 will release the downhole tool 88. Withdrawal of the applied pressure through port 100 will simply allow the spring 56 to push down the gripping ring 54 into the position shown in FIG. 6*b* so that it is now ready to accept, when removed from the wellbore, another tool which can be run and engaged to the tool 88 which is already in the wellbore. Accordingly, the apparatus A does not need to be redressed whenever it is brought out of the well. There are no shear pins involved in the design which must be removed and replaced after an individual use. The apparatus A is designed to bleed off the trapped hydrostatic pressure in annular passage 72 so that when it is withdrawn from the well, the only internal pressures are the initial charge pressure to annular cavity 34. That pressure in cavity 34 can be safely bled off using the fill port 18 and plug 28, with appropriate piping. The apparatus A is simple and reliable. It is preferred to charge the annular cavity 34 with a pressure slightly below the anticipated hydrostatic at the depth to which the downhole tool 88 can be delivered. Any type of downhole tools can be conveyed with the apparatus A, including perforating guns and packers or bridge plugs, as an example. The tool can also be used as a fishing tool to grab any downhole tool which has a fishing neck defined by a recess, such as 92. Those skilled in the art will appreciate that the parts of the apparatus can be reconfigured so that when used in a fishing application, it can either act as an overshot, as disclosed in these figures, or as a spear to go inside of a stuck tool that happens to have an internal recess for fishing purposes. Although the apparatus A has been shown as ideal for use with a line 14, rigid or coiled tubing can also be connected to connection 10 without departing from the spirit of the invention.

The foregoing disclosure and description of the invention are illustrative and explanatory thereof, and various changes in the size, shape and materials, as well as in the details of the illustrated construction, may be made without departing from the spirit of the invention.

What is claimed is:

1. A running tool for downhole delivery of at least one downhole tool, comprising:

a body;

a gripping member supported by said body for selective retention of the downhole tool;

a release member movable in said body for selective actuation of said gripping member, said release member having a first and second end, said first end exposed to applied and hydrostatic pressures downhole while said second end is selectively exposed to applied pressures downhole.

2. The running tool of claim 1, further comprising:

a line to support said body for insertion and removal from the wellbore.

3. A running tool for downhole delivery of at least one downhole tool, comprising:

a body;

a gripping member supported by said body for selective retention of the downhole tool;

a release member movable in said body for selective actuation of said gripping member, said release member having a first and second end, said first end exposed to pressures downhole while said second end is selectively exposed to pressures downhole;

said exposure of said second end to wellbore pressures is dependent upon the support of the weight of the downhole tool by said body.

4. The running tool of claim 3, wherein:

said body further comprises an outer body such that the weight of the downhole tool urges said outer body to a first position where said second end of said release member is exposed to wellbore pressures, whereupon when the downhole tool is otherwise supported, said outer body, in a second position, isolates downhole pressures from said second end of said release member.

5. The running tool of claim 4, wherein:

said outer body is biased toward its said second position.

6. The running tool of claim 5, wherein:

said body further comprises a mandrel and a sleeve mounted to said mandrel defining a first chamber therebetween, said sleeve comprising a port into said first chamber, said outer body selectively covering said port, said second end of said release member exposed to said first chamber.

7. The running tool of claim 6, wherein:

said outer body covers said port in its said second position.

8. The running tool of claim 7, further comprising:

a second chamber separated from said first chamber by a movable piston.

9. The running tool of claim 8, wherein:

said second chamber containing a compressible fluid.

10. The running tool of claim 9, wherein:

said compressible fluid is initially charged into said second chamber to a pressure near the anticipated wellbore hydrostatic pressure at the depth the downhole tool will be released.

11. The running tool of claim 9, wherein:

said movable piston movable between two travel stops;

said compressible fluid maintaining said movable piston between said travel stops when at a predetermined depth, said outer body is moved to its said second position.

12. The running tool of claim 11, wherein:

applied pressure in the wellbore to said first end of said release member, with said outer body in said second position, moves said release member which, in turn, moves said piston and raises the pressure of said compressible fluid in said second chamber while releasing the downhole tool from said gripping member.

13. The running tool of claim 12, wherein:

said first chamber comprises a valve exposed to downhole pressures;

whereupon release of the downhole tool by movement of said release member, and return movement of said outer body to its said second position, trapping downhole pressure in said first chamber, said trapped pressure in said first chamber is relieved at least in part through said valve.

14. The running tool of claim 13, wherein:

said valve comprises a biased poppet;

said outer body continuing to seal off said first cavity as said body is removed from the wellbore while no longer supporting the downhole tool, whereupon said valve opens due to the reduction in hydrostatic pressure around said body as it is raised in the wellbore.

15. The running tool of claim 14, wherein:

the residual pressure in said first cavity upon removal of said body from the wellbore is a function of the strength of said bias which comprises a spring and the area of said poppet exposed to said first chamber.

16. The running tool of claim 6, wherein:

said mandrel cams said gripping member radially for release from the downhole tool as a result of translation of said release member.

17. The running tool of claim 16, wherein:

said gripping member is biased toward a support surface on said outer body.

18. A running tool for downhole delivery of at least one downhole tool, comprising:

a body;

gripping member supported by said body for selective retention of the downhole tool;

a release member movable in said body for selective actuation of said gripping member, said release member having a first and second end, said first end exposed to pressures downhole while said second end is selectively exposed to pressures downhole;

said gripping member is movably mounted to said body for multiple engagement and release of a plurality of downhole tools without disassembly.

19. The running tool of claim 18, wherein:

said gripping member is movable by a downhole tool to a position where it is displaced sufficiently to allow insertion of the downhole tool into said body;

said gripping member is biased toward a support surface on said body whereupon said gripping member latches to the downhole tool automatically upon sufficient insertion of the downhole tool into said body.

20. A running tool for downhole delivery of at least one downhole tool, comprising:

a body;

a gripping member supported by said body for selective retention of the downhole tool;

a release member movable in said body for selective actuation of said gripping member, said release member having a first and second end, said first end exposed to pressures downhole while said second end is selectively exposed to pressures downhole;

said gripping member retaining the downhole tool despite the downhole tool becoming independently supported in the wellbore.

21. The running tool of claim 20, wherein:

said gripping member only releasing the downhole tool upon applied wellbore pressure at a predetermined level above hydrostatic pressure in the wellbore adjacent said body.

* * * * *